US005567207A

United States Patent [19]

Lockman et al.

[11] Patent Number: 5,567,207

[45] Date of Patent: Oct. 22, 1996

[54] METHOD FOR MARKING AND FADING TEXTILES WITH LASERS

[75] Inventors: William J. Lockman, Longwood; Frank J. Clayson, Apopka, both of Fla.

[73] Assignee: Icon, Inc., Apopka, Fla.

[21] Appl. No.: 274,473

[22] Filed: Jul. 31, 1994

[51] Int. Cl.[6] ..... D06P 5/20

[52] U.S. Cl. ..... 8/444; 8/115.52; 8/115.53

[58] Field of Search ..... 8/444, 115.52, 8/13

[56] References Cited

U.S. PATENT DOCUMENTS

| | | | |
|---|---|---|---|
| 4,847,184 | 7/1989 | Taniguchi et al. | 430/346 |
| 4,861,620 | 8/1989 | Azuma et al. | 427/53.1 |
| 4,901,089 | 2/1990 | Bricot | 366/76 L |
| 5,017,423 | 5/1991 | Bossmann et al. | 428/224 |
| 5,248,878 | 9/1993 | Ihara | 219/121 |

FOREIGN PATENT DOCUMENTS

| | | |
|---|---|---|
| 3916126 | 5/1989 | Germany . |
| 5-278237 | 10/1993 | Japan . |

*Primary Examiner*—Margaret Ensman
*Attorney, Agent, or Firm*—Maguire, Voorhis & Wells, P.A.

[57] ABSTRACT

The present invention relates to an environmentally safe, water-free method for color fading and for producing patterns on textile materials (1, 10) by exposure to laser radiation (7, 12) of sufficient intensity to cause photodecomposition of the coloring agent while leaving the underlying textile material undamaged. The pre-dyed material (1, 10), such as denim, is scanned by a laser beam (19, 20) generated by a selected laser having selective output characteristics to produce uniform fading and patterns of photo-bleached marks on the textile material (1, 10). When the laser radiation is modulated at a selected frequency, the fading may take the form of stone washing (18*a* and 18*b*), echo ball washing, or acid washing techniques commonly used on denim materials. The patterns (17*a* and 17*b*) may take the form of any desired image, line, or picture in the substrate material. For mass production the textile materials may be moved under the laser by a conveyer belt or similar means.

33 Claims, 2 Drawing Sheets

METHOD FOR MARKING AND FADING TEXTILES WITH LASERS

BACKGROUND OF THE INVENTION

This invention relates to methods of uniform color fading, fading with patterns and marking patterns onto textiles materials, such as denim, using lasers. More particularly, it relates to using lasers to simulate conventional laundering techniques, such as stone washing, echo ball washing and acid washing without the use of water or chemicals. Still more particularly, it relates to performing the above mentioned process in an environmentally safe manner.

It is known that laser beams are used to record patterns in various materials. The great heat available when the laser beam is focused to a small spot can be used to change the physical properties of a material. In previous methods, the visible change in the material properties are produced by burning, charring, melting or other severe modifications of the physical characteristics of the material.

The present invention describes a method where intense laser radiation is directed onto a pre-dyed textile material such as denim. The laser parameters such as wavelength, average power, pulse duration, power density, and scan speed are adjusted to provide efficient absorption into the dye components of the textile material. The absorption of the laser radiation by the dye components results in rapid and selective photo-decomposition of the dye elements. The result of controlled exposure is a color fading or color removal effect.

Vapors and debris resulting from the rapid photo-decomposition of the dye elements in the textile material can be easily removed from the work environment by standard suction and filtration machinery now used in many industrial applications. In the industrial environment, this method is best applied on a moving web of textile material. In the case of broad coverage, the laser beam is scanned across the material in a direction perpendicular to the direction of the textile. The laser beam scan rate, power density, average power, pulse width, and repetition rate are synchronized to the speed of the textile material such that the desired fading pattern is created.

Currently, fading of textile materials, such as denim, is accomplished on finished clothing articles by a multi-stage laundering process that utilizes conventional washing machines, large quantities of water, and various chemical and mechanical additives that act on the fabric to produce the desired fading effects. Stone wash methods use actual stones or rocks in the washing process. These stones impact the denim material and result in the desired fading pattern. A variation of this method uses golf balls in place of stones in the washing process. This "Echo Ball" washing technique results in a similar pattern to that of stone watching. Another method of fading finished denim clothing is with the use of chemicals in an aqueous mixture containing alkaline or chlorine that causes a uniform fading of the colored textile material. More recent developments have included using enzymes or other bacteriological agents in the fading process.

Large amounts of water are used in the previous stone washing, echo ball washing, and acid washing fading methods. As much as 15 gallons of water is used per clothing article in these processes. At current annual production rates, the textile industry uses six billion gallons of water per year in the U.S. for denim finishing operations. Moreover, the water used in these processes is contaminated with dyes and other chemicals and often requires purification before being discharged. When purification is not required by law, the contaminated waste water is discharged into the environment.

All previous methods perform the fading process on textile materials that have been cut and sewn to form completed clothing article. This is the most practical method available today since conventional finishing methods are performed in industrial washing machines. Significant improvements could be realized in the manufacturing process if a method could be found to perform the fading operation on the material prior to it being cut and sewn into finished garment form.

Fading denim material after it is cut and sewn into finished garments adds time, labor, resources and costs to the finishing process. Thus, a need exists for uniformly fading and fading with patterns textile materials such as denim without the use of water or harsh chemicals. A need also exists for a method of fading and marking textile materials prior to assembly into finished garments.

Currently, marking detailed patterns on colored textile fabric, such as denim, is accomplished by methods similar to laser printers where dye is made to adhere to specific areas of a drum mechanism exposed to laser radiation. The drum with dye components is rolled across wet textile material to transfer the pattern. Other methods include applying heat to a film placed on the fabric.

Still other methods include the use of laser radiation to heat the textile to allow for better adhesion by the dyes. The prior patented art includes some methods for using a laser to mark various items, including textiles, but most require the use of wet dye solutions and none is like the present invention.

U.S. Pat. No. 4,861,620 by Azuma, et al., issued Aug. 29, 1989, describes a method of laser marking which requires that a pigment coating be placed on the surface of the article being marked. Then a focused laser beam is used to affect the internal molecular structure of the pigment to change color. U.S. Pat. No. 4,901,089 by Bricot, issued Feb. 13, 1990, discloses a method and device for the recording of pictures by laser which requires several layers of material be placed on a substrate. A laser beam is used to ablate the top material to form an image. U.S. Pat. No. 4,847,184 by Taniguchi, et al., issued Jul. 11, 1989, teaches a method for transferring a still video image onto a substrate that is carbonizeable or discolorable. Unlike the present invention, this technique engraves a pattern into the substrate to form a pattern of some depth. U.S. Pat. No. 5,017,423 by Bossmann, et at., issued May 21, 1991, teaches a process for manufacturing textile materials using lasers. In this method, a laser beam is used to cause a physical change in the textile material. This change, due to charring and burning effects, results in a larger cross-sectional area being exposed to the dyeing process. The larger cross section of the textile results in better dye adhesiveness. U.S. Pat. No. 5,248,878 by Ihara, issued Sep. 28, 1993, concerns marking golf balls using lasers. Finally, German Patent No. 39 16 126, involves using a laser beam to print a pattern on textile fabrics that is wet with dye. This latter method creates a pattern on the material by changing the color of the dye. Thus, a need exists for a method for marking various detailed patterns on colored textile fabrics without damaging the fabrics.

Unlike the above patents, the present invention uses an environmentally safe method for marking, fading and treating textile fabrics with a laser without the need for conventional washing methods, wet dyes, or excessive amounts of water.

SUMMARY OF THE INVENTION

The primary object of the present invention is to provide an improved and environmentally safe, water free method for uniformly fading and fading with patterns various textile materials, including finished colored denim, using a laser.

Another object of the present invention is to provide an environmentally safe, water free process for producing stone washing and acid washing effects on various textile materials, including finished colored denim, with lasers.

Another object of the present invention is to provide a method for marking patterns and images on various textile materials, including finished colored denim, using a laser.

Another object of the present invention is to provide such a method that does not damage the textile material on which it is used.

Another object of the present invention is to provide such a method that does not require the use of chemicals or acids.

The present invention fulfills the above and other objects by providing a method for color fading and producing patterns on textile materials with a laser by placing under the laser a pre-dyed textile material and then scanning a laser beam having a selected wavelength, power density, pulse width, and repetition rate over the textile material until the desired degree of fading or the selected pattern is achieved. The laser would preferably be a q-switched Nd:YAG laser with a wavelength of about 1064 nanometers, although other lasers, such as $CO_2$ gas lasers or Excimer gas lasers may be utilized. The wavelength of the laser is chosen to give optimal dye photo-decomposition without affecting the textile material.

The scanning of the laser beam over the textile material may be controlled by galvanometric mirror, acousto-optic deflector, deflector, magneto-optic beam deflector, polygon mirror, or a moving holographic optical element. The textile material may be made of natural, synthetic, woven, knit, or pressed fiber textile materials.

The patterns which would be made of a series of lines and/or dots may take the form of images, text, or pictures on the textile material.

These and other objects, advantages, and features of the present invention will become even more readily apparent when the preferred embodiments are discussed in conjunction with drawings.

BRIEF DESCRIPTION OF THE DRAWINGS

The drawing figures used in conjunction with the description of the preferred embodiments are as follows.

DESCRIPTION OF THE PREFERRED EMBODIMENTS

Referring now to the accompanying drawings, the present invention is described in more detail.

Figure 1:
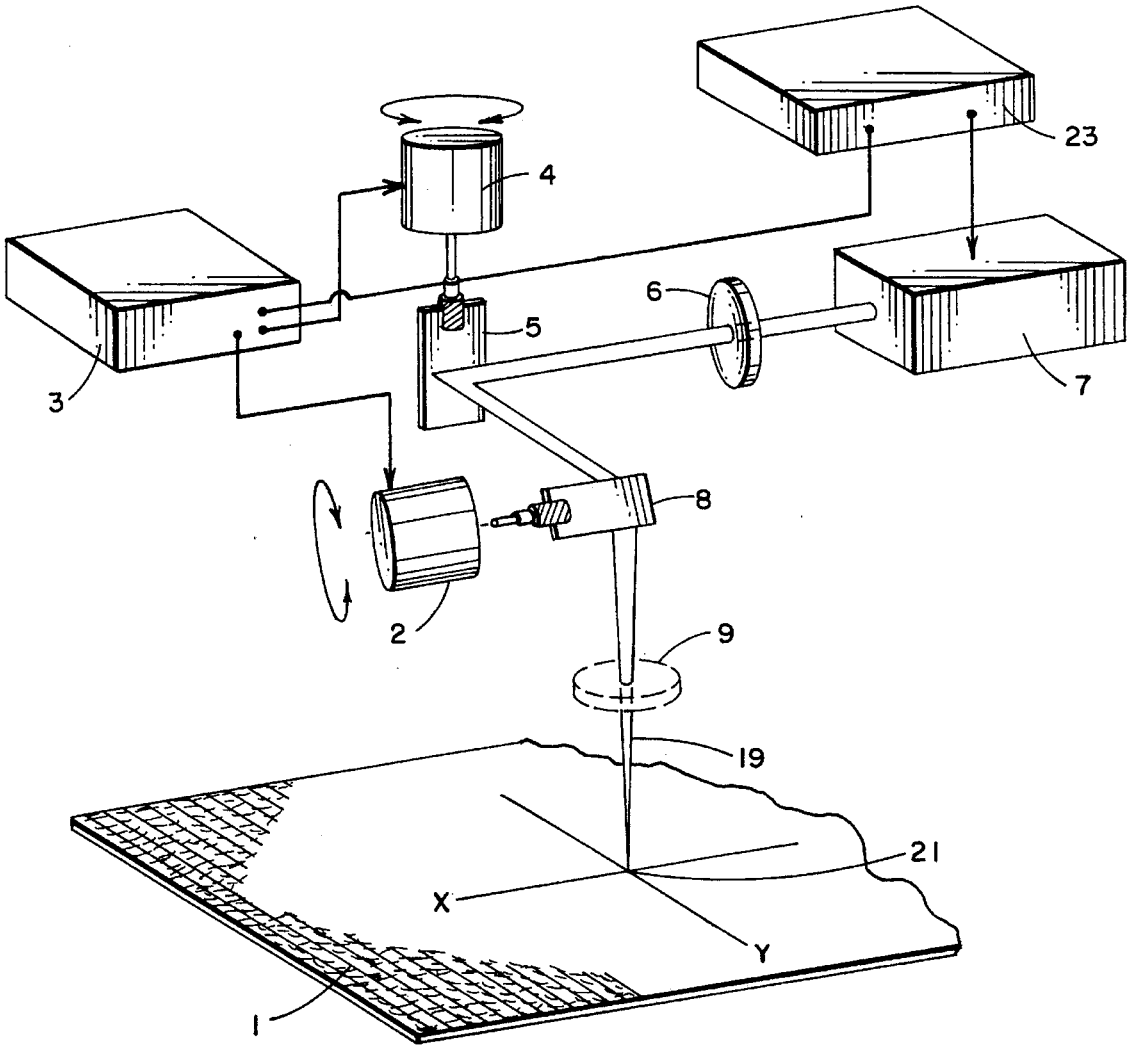
FIG. 1 is a perspective schematic view of a typical set up using the present invention involving a computer-controlled laser to uniformly fade or make patterns.

In FIG. 1, which is the simplified block diagram of the textile marking apparatus, the scanning mirrors and the laser parameters such as output power and repetition rate are set by the laser controller 23 and a Central Processing Unit (CPU) 3. The parameters for the desired pattern to be made on the textile 1 is programmed into the CPU 3. The beam position and laser intensity are rapidly modulated to produce the desired stone wash effects.

The CPU 3 has graphic information and formatted instructions to drive the galvanometric mirrors and control the laser parameters in order to produce the desired pattern on the textile material. As per the command sequence, a q-switched laser beam 19 originates from a laser oscillator 7. The laser oscillator 7 may be a Nd:YAG laser or other laser source, q-switched with an acousto-optic or electro-optic modulator. The laser beam may follow an optical system (not shown for clarity) that directs the beam onto an x-axis mirror 5 controlled by an x-axis galvanometer 4 and a y-axis mirror 8 controlled by an y-axis galvanometer 2. The beam is reflected from the x-axis mirror, which controls beam movement in the x-axis, onto the y-axis mirror, which controls beam movements in the y-axis. The laser beam propagates through the focusing lens 6 and onto the textile material. The focusing lens can be located before or after the x and y scanning mirrors. As the x-axis and y-axis mirrors are moved, the focused laser beam 21 moves across the textile substrate as directed by the CPU 3.

Using the present invention broadly could achieve a stone-wash appearance on a textile or jeans with much less water use or damage to the textile material than that which occurs through actual stone washing.

Figure 2:
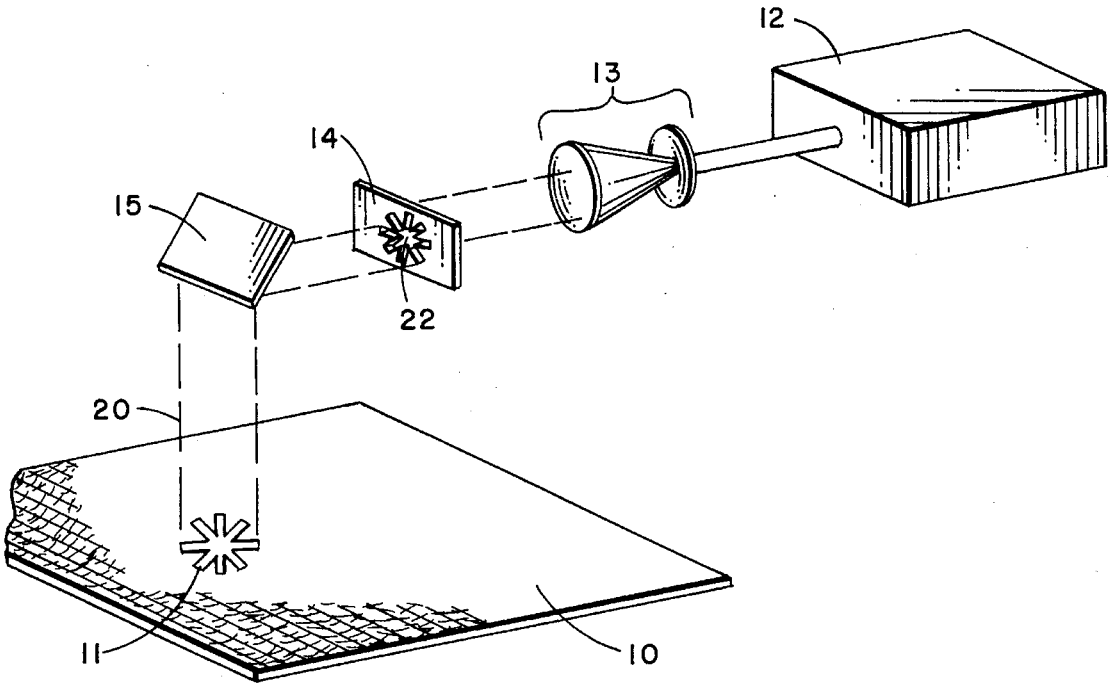
FIG. 2 is a perspective view of a mask set up to produce patterns using a laser.

A second embodiment of this invention is illustrated in FIG. 2. Although the method illustrated in FIG. 1, which utilizes a computer 3 to control the operation is a typical set up, the second embodiment shown in FIG. 2 uses a mask instead to project an entire image or pattern 11 on the textile 10. In this embodiment the laser 12 projects a laser beam into a beam expander 13 which consists of two lenses similar to a telescope. The expanded beam is then projected through a mask 14 containing an aperture 22 in the shape of the desired pattern 11 to be projected on the textile 10. The patterned laser beam 22 is then reflected off a mirror 15 directly onto the textile 10 for a predetermined period in order to form the desired pattern 11 on the textile 10.

Figure 3:
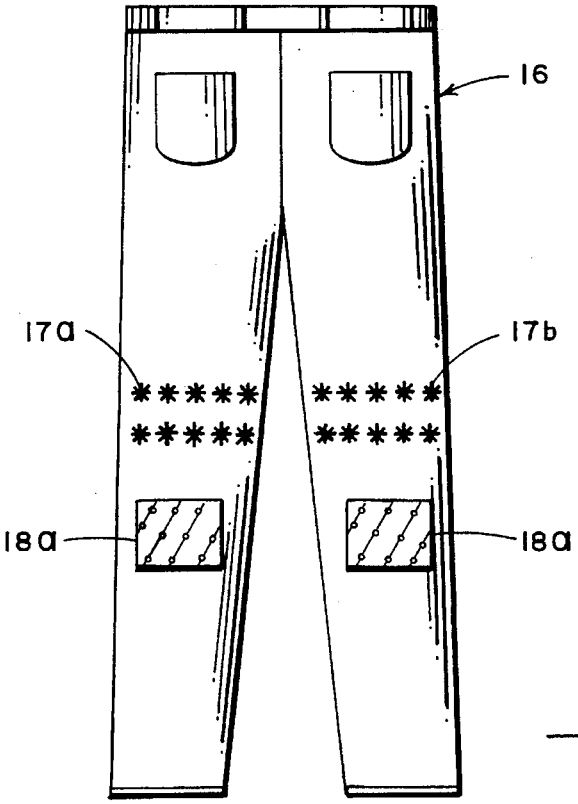
FIG. 3 is a frontal view of dungarees made using this method showing selected patterns made by a laser.

The final illustration, FIG. 3, shows a pair of denim jeans 16 which has been subjected to this method for laser marking and treatment of textile materials. On the jeans 16 are shown two different patterns, one being a design pattern **17*a* and 17*b*, which is made with a series of lines, such as that which would be made with either the set up illustrated in FIG. 1 or the set up in FIG. 2**. It is contemplated that this inventive process may be implemented in the manufacture of textile material prior to being cut into clothing forms, and during the transport of such uncut material on a conveyor belt during the manufacturing process.

This type of pattern would more likely result from the set up illustrated in FIG. 1. A second type of pattern that is shown is the stone wash pattern of **18*a* and 18*b*. This type of pattern would also result for the set up illustrated in FIG. 1. Depending on the intensity of the beam and the time it is allowed to remain on the textile, the patterns illustrated in FIG. 3** could be the result of selective photo-decomposition resulting in a white or faded appearance where the pattern is located on the denim. The inventors have conducted numerous experiments to test their method, arriving at various parameters for use of the method. All experiments to date have been done using the Nd:YAG laser with a wavelength of around 1064 nanometers. The laser beam may be generated by a frequency doubled Nd:YAG laser having a wavelength of approximately 532 nm.

Other possible wavelengths for other laser sources range between 190 nanometers to 10600 nanometers. An Excimer laser may operate effectively at wavelengths 196 nm to 235 nm, or a CO laser may operate effectively at 10600 nanometers. The wavelength of the laser should be chosen such that it is strongly absorbed by the dye to be faded but not by the textile material. The range of pulse duration used has been from 5 nanoseconds to 100 microseconds, with the best results being from 20 to 350 nanoseconds. Other variables, such as the pulse energy, peak power, scan speed, dot pitch, and energy density play an important factor in the degree of photo-decomposition and the avoidance of damage to the textile material.

For example, these variable parameters may include the laser beam having a repetition rate from 1 hertz to 500 MHz ($500\times10^6$ hertz), a pulse duration between approximately 10 fs ($10\times10^{-15}$ seconds) to 500 ms ($500\times10^{-3}$ seconds), the laser beam may have a continuous output beam and is classified as a cw laser, or the laser beam have a scan speed of 1 mm per minute to 500 meter/second, and a dot pitch between 0.1 um to 5 meters.

Although only the preferred embodiments of this invention have been described in detail hereinabove, it is intended that all variations and modifications of this invention within the scope of the claims are covered by this invention.

Having thus described our invention, we claim:

1. A method for color fading, dyed textile materials with a laser, comprising the steps of:

placing under a laser beam a dyed textile material; and scanning the laser beam generated by the laser with a selected set of parameters to fade the dye of the textile material to replicate a uniformly faded textile or a stone washed, acid washed or acid ball washed textile.

2. The method of claim 1 wherein the textile material is denim and the parameters are chosen so the laser beam fades the dye on the textile material to replicate the look of a stone washed denim.

3. The method of claim 1 wherein the textile material is denim and the parameters are chosen so the laser beam fades the dye on the textile material to replicate a uniformly faded denim.

4. The method of claim 1 wherein the textile material is a denim and the parameters are chosen so the laser beam fades the dye on the textile material to replicate a look of acid washed denim.

5. The method of claim 1 wherein the textile material is a denim and the parameters are chosen so the laser beam fades the dye on the textile material to replicate a look of echo ball washed denim.

6. The method of claim 1 wherein the laser beam is generated by a Nd:YAG laser having a wavelength of approximately 1064 nm.

7. The method of claim 1 wherein the laser beam is generated by a frequency doubled Nd:YAG laser having a wavelength of approximately 532 nm.

8. The method of claim 1 wherein the laser beam is generated by a $CO_2$ gas laser having a wavelength of approximately 10600 nm.

9. The method of claim 1 wherein the laser beam is generated by a Excimer laser having a wavelength from approximately 196 nm to 235 nm.

10. The method of claim 1 wherein placing the textile material under the laser beam is accomplished by use of a conveyer belt on which the textile material is placed.

11. The method of claim 1 wherein the laser beam has a repetition rate from 1 hertz to 500 MHz ($500\times10^6$ hertz.)

12. The method of claim 1 wherein the laser beam has a pulse duration between approximately 10 fs ($10\times10^{-15}$ seconds) to 500 ms ($500\times10^{-3}$ seconds).

13. The method of claim 1 wherein the laser beam has a continuous output beam and is classified as a cw laser.

14. The method of claim 1 wherein the laser beam is scanned across the textile material at a rate between approximately 1 mm per minute to 500 meters per second.

15. The method of claim 1 wherein the dot pitch of the laser beam is between approximately 0.1 um to 5 meters.

16. The method of claim 1 wherein the scanning of the laser beam is carried out by a galvanometric controlled mirror.

17. The method of claim 1 wherein the scanning of the laser beam is carried out by an acousto-optic beam deflector.

18. The method of claim 1 wherein the scanning of the laser beam is carried out by an electro-optic beam deflector.

19. The method of claim 1 wherein the scanning of the laser beam is carried out by an magneto-optic beam deflector.

20. The method of claim 1 wherein the scanning of the laser beam is carried out by a polygon mirror.

21. The method of claim 1 where in the scanning of the laser beam is carried out by a moving holographic optical element.

22. The method of claim 1 wherein the textile material is made of denim.

23. The method of claim 1 wherein the textile material is made of woven textile.

24. The method of claim 1 wherein the textile material is made of any natural, synthetic, blended, woven, knit or pressed fiber textile material.

25. The method of claim 1 wherein the laser beam is scanned across the uncut web of textile material.

26. The method of claim 1 wherein the laser beam is scanned across completed garments.

27. A method for fading textile materials treated with a dye, comprising the steps of:

(a) providing a source of laser radiation; and, (b) irradiating the textile material with a laser beam scanned under preselected parameters for absorption by the dye to uniformly fade said dye.

28. The method of claim 27 wherein the laser beam is generated by a Nd:YAG laser having a wavelength of approximately 1064 nm.

29. The method of claim 27 wherein the laser beam has a repetition rate from 1 hertz to 500 MHz (500 c $10^6$ hertz).

30. The method of claim 27 wherein the laser beam has a pulse duration between approximately 10 fs ($10\times10^{-15}$ seconds) to 500 ms ($200\times10^{-3}$ seconds).

31. The method of claim 27 wherein the laser beam has a continuous output beam and is classified as a cw laser.

32. The method of claim 27 wherein the laser beam is scanned across the textile material at a rate between approximately 1 mm per minute to 500 meters per second.

33. The method of claim 27 wherein the dot pitch of the laser beam is between approximately 0.1 um to 5 meters.

* * * * *

UNITED STATES PATENT AND TRADEMARK OFFICE
Certificate

Patent No. 5,567,207 Patented: October 22, 1996

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William J. Lockman, Longwood, FL; Frank J. Clayson, Apopka, FL; and Wayne K. Shaffer, Apopka, FL.

Signed and Sealed this First Day of March 2005.

YOGENDRA N. GUPTA
*Supervisory Patent Examiner*
Art Unit 1751